US005570163A

United States Patent [19]

Yamauchi

[11] Patent Number: 5,570,163

[45] Date of Patent: Oct. 29, 1996

[54] CHARGING DEVICE AND IMAGE FORMING APPARATUS HAVING THE SAME

[75] Inventor: Shin Yamauchi, Tokyo, Japan

[73] Assignee: Kabushiki Kaisha Toshiba, Kawasaki, Japan

[21] Appl. No.: 267,381

[22] Filed: Jun. 29, 1994

[30] Foreign Application Priority Data

| | | | |
|---|---|---|---|
| Jun. 29, 1993 | [JP] | Japan | 5-158379 |
| May 27, 1994 | [JP] | Japan | 6-115464 |
| Jun. 22, 1994 | [JP] | Japan | 6-140499 |

[51] Int. Cl.[6] ..... G03G 15/02

[52] U.S. Cl. ..... 355/221; 355/219; 361/225; 361/230

[58] Field of Search ..... 355/219, 221, 355/225; 361/230, 225; 250/324–326

[56] References Cited

U.S. PATENT DOCUMENTS

| | | | |
|---|---|---|---|
| 3,762,811 | 10/1973 | Matsumoto | 355/221 X |
| 3,900,776 | 8/1975 | Lauker | 361/225 |
| 4,908,513 | 3/1990 | Masuda et al. | 250/324 |
| 5,173,734 | 12/1992 | Shimizo et al. | 355/219 X |

FOREIGN PATENT DOCUMENTS

| | | | |
|---|---|---|---|
| 0050554 | 3/1985 | Japan | 355/321 |
| 0142340 | 7/1985 | Japan . | |
| 61-49365 | 4/1986 | Japan . | |
| 0098368 | 5/1986 | Japan | 355/321 |
| 61-45231 | 10/1986 | Japan . | |
| 0228469 | 10/1986 | Japan | 355/321 |

*Primary Examiner*—Matthew S. Smith
*Attorney, Agent, or Firm*—Foley & Lardner

[57] ABSTRACT

In a charging device constituted by a charging wire and a shield case having a U-shaped sectional structure which surrounds the charging wire and has an opening portion opposing a photosensitive body, the peak of a current flowing from the opening of the shield case onto the photosensitive body is offset to the upstream side in the rotational direction of the photosensitive body with respect to the central position of the shield case to uniform a charging potential at an outlet portion of the shield case. According to the above charging device, the peak of the charging flow-in current is offset to the upstream side in the rotational direction of the photosensitive body with respect to the central position of the shield case. For this reason, the peak of discharging is present near the inlet portion of the shield case, and a half or more of a finally obtained halftone potential is obtained on the inlet side. However, a charging irregularity occurs due to a large potential ripple. At the outlet position of the shield case, although an amount of charge contributing to a charging operation is smaller than that of the inlet position, an amount of charge for uniforming the charging operation increases. For this reason, the potential ripple decreases, and the charging operation is uniformed finally. Therefore, even when a photosensitive body having a small surface roughness and subjected to a mirror-surface process is used, a charging operation free from ununiformity of a halftone image can be performed.

7 Claims, 10 Drawing Sheets

| | | SURFACE ROUGHNESS OF PHOTOSENSITIVE DRUM (Rz) | | | | | | | | |
|---|---|---|---|---|---|---|---|---|---|---|
| | | 0.1 | 0.2 | 0.3 | 0.4 | 0.5 | 0.6 | 0.7 | 0.8 | 0.9 |
| NUMBER OF COPIES FOR CAUSING OMISSIONS IN IMAGE | | ∞ | ∞ | 200K | 200K | 150K | 150K | 50K | 10K | 5K |
| RATIO OF NON-UNIFORM IMAGE AREA TO TOTAL AREA OF HALFTONE IMAGE (%) | WIRE POSITION (b) | 0 | 0 | 0 | 0 | 0 | 0 | 0 | 0 | 0 |
| | WIRE POSITION (c) | 80 | 80 | 70 | 50 | 50 | 50 | 40 | 0 | 0 |
| | WIRE POSITION (d) | 90 | 90 | 80 | 70 | 60 | 60 | 50 | 20 | 0 |

FIG. 10A

CHARGING DEVICE AND IMAGE FORMING APPARATUS HAVING THE SAME

BACKGROUND OF THE INVENTION

1. Field of the Invention

The present invention relates to a charging device for uniformly charging an object to be charged such as a photosensitive body and an image forming apparatus such as an electrophotographic copying apparatus having the charging device.

2. Description of the Related Art

For example, in an electrophotographic copying apparatus, after a photosensitive body serving as an image carrier is uniformly charged, an image is exposed on the photosensitive body, thereby forming a latent image corresponding to an original. In addition, a toner is electrostatically attracted to the latent image on the photosensitive body to form a toner image, and this toner image is transferred to paper.

As a conventional charging device for uniformly charging a photosensitive body, a corotron charging device has been popularly used.

This corotron charging device comprises a charging wire (also called a corona discharging wire) and a shield case having a U-shaped sectional structure which surrounds the charging wire and has an opening portion opposing the photosensitive body serving as an object to be charged.

A high voltage is applied to the charging wire to cause the charging wire to generate a corona current, and this current flows onto the photosensitive body, thereby supplying charges onto the surface of the photosensitive body.

On the other hand, in an electrophotographic copying apparatus, an increase in copy speed is strongly demanded. For this reason, as the image carrier of a high-speed copy machine, a highly photosensitive material such as arsenic selenide is used.

In addition, the highly photosensitive material such as arsenic selenide sets the surface of a photosensitive body in a mirror-surface state and eliminates disadvantages caused by a large surface roughness to prolong the service life of the photosensitive body. That is, this material prevents a discharging effect caused by a pin-like projection or a charging fault caused by entering paper dust or a toner into recessed portions in the surface of the photosensitive body.

A conventional charging device has an arrangement in which one charging wire is arranged at the central position of the opening width of the shield case. Another conventional charging device has an arrangement in which two charging wires are arranged at symmetrical positions with respect to the central position of the opening width of a shield case.

In addition, a charging device having an arrangement in which a charging wire is offset to the downstream side of a shield case as described in Jpn. Pat. Appln. KOKAI Publication No. 61-210370 such that a voltage applied to the charging wire is set to be low to obtain a predetermined charging amount, has been developed.

with the above arrangement, the peak of a corona current (flow-in current) flowing from the opening portion of the shield case onto the rotating photosensitive body is set at or near the central position of the opening width of the shield case or a position offset to the downstream side with respect to the central position of the shield case.

However, when the charging wire is arranged at the central position of the shield case or the position offset to the downstream side in the rotational direction of the photosensitive body, the peak of charging is set at the central position of the shield case or the position offset to the downstream side in the rotational direction of the photosensitive body. In this case, a charging irregularity disadvantageously occurs.

A case wherein a charging irregularity occurs when a drum having a rough surface which is not subjected to a mirror-surface process is used will be considered. For example, on a drum having a surface which has a surface roughness $R_Z \approx 0.8$ and on which fine projecting and recessed portions are present, since both the projecting and recessed portions are charged, an amount of charge per unit area is large. For this reason, even when some charging irregularity occurs, an amount of charge per unit area does not largely vary, and a degree of attraction of the toner is rarely influenced.

In contrast to this, when a planished drum having, e.g., a surface roughness $R_Z \approx 0.2$ is used, since no projecting and recessed portions are present on the surface of the photosensitive body, an amount of charge per unit area is small. For this reason, when a charging irregularity occurs in an area, an amount of charge in the area largely varies, and an area on which no charges are present is formed on the surface of the photosensitive body. Therefore, the toner is not attracted to this area, thereby forming pitmarks in the resultant image. In particular, this phenomenon becomes conspicuous when a halftone image is output, and the phenomenon is a problem to be solved when a planished drum is used.

SUMMARY OF THE INVENTION

The present invention has been made to solve the problems of the prior art, and has as its object to provide a charging device and an image forming apparatus having the charging device, in which an occurrence of a charging irregularity, when the photosensitive body is charged, is prevented by changing the position of the peak portion of a flow-in current with respect to the opening width of a shield case, and a good charging operation can be performed without forming non-uniformity in a halftone image even when an object to be charged is a highly photosensitive body which is subjected to a mirror-surface process and consists of arsenic selenide.

As a charging device capable of achieving the above object, there is provided a charging device comprising:

- a shield case having a U-shaped sectional structure which has an opening opposing an object to be charged rotated in a predetermined direction; and
- a charging wire arranged such that a peak of a current flowing from the opening of the shield case onto the object in the shield case is offset to an upstream-side in a rotational direction of the object with respect to a central position of the shield case.

In the corotron charging device, the peak portion of a corona current flowing onto the object is offset to the upstream side in the rotational direction of the object with respect to the central position of the shield case. For this reason, the potential at the outlet portion of the shield case is uniformed to prevent a charging irregularity. Therefore, even when the surface roughness of the object is very small, a preferable image can be obtained.

More specifically, according to the above charging device, the peak of a charging flow-in current is offset to the upstream side in the rotational direction of the object with respect to the central position in the widthwise direction of the shield case. For this reason, a discharging peak is present in the inlet side of the shield case, and a charging irregularity temporarily occurs on the inlet side due to a large potential ripple. However, since the charging operation is continuously performed with a small flow-in current before the portion in which the charging irregularity occurred reaches the outlet portion of the shield case, the photosensitive body is uniformly charged.

In this manner, even when a photosensitive body which has a very small surface roughness and is subjected to a mirror-surface process is used, a charging operation can be performed without any irregularity, and non-uniformity of a halftone image can be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 10A is a table showing a disadvantageous state in an experiment performed using a surface roughness ($R_Z$) of a photosensitive member as a parameter;

DETAILED DESCRIPTION OF THE PREFERRED EMBODIMENTS

An embodiment of the present invention will be described below with reference to FIGS. 1 to 9A, 9B, and 9C.

Figure 1:
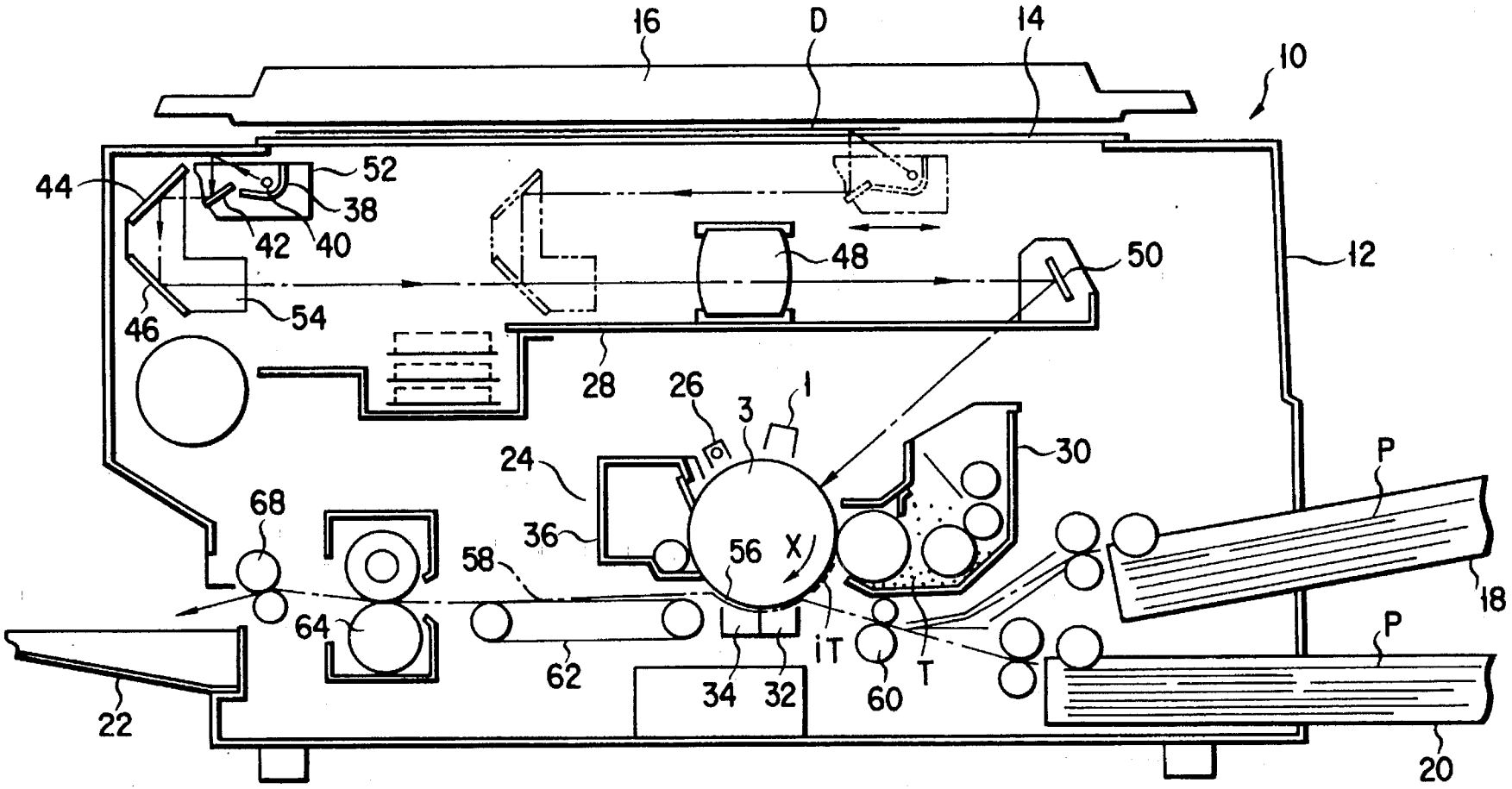
FIG. 1 is a schematic front view showing an electrophotographic copying apparatus to which an embodiment of the present invention is applied.

FIG. 1 is a schematic view showing the arrangement of an electrophotographic copying apparatus 10 serving as an image forming apparatus to which a charging device 1 according to the present invention is applied. A platen glass 14 serving as an original table is arranged on the upper surface of the apparatus main body 12. An original cover 16 for covering an original D placed on the platen glass 14 is pivotally arranged on the upper surface of the apparatus main body 12, and a control panel (not shown) serving as an input/display means is arranged along the front edge portion of the apparatus main body 12.

An upper paper cassette 18 and a lower paper cassette 20 are attached to the right side of the apparatus main body 12, and a copy tray 22 is arranged on the left side of the apparatus main body 12.

An image forming means 24 for forming an image on paper (plain paper, OHP sheet, or the like) P which serves as an object to be transferred and is automatically supplied from the paper cassette 18 or 20 and discharging the resultant paper to the copy tray 22 is arranged inside the apparatus main body 12.

This image forming means 24 has the following arrangement.

That is, a photosensitive drum 3 serving as an image carrier is rotatably arranged at the almost central portion of the apparatus main body 12.

The photosensitive drum 3 has a smoothened surface and a surface roughness $R_Z$=0.1. A photosensitive drum processed to have a very small surface roughness as described above is called a planished drum.

Around the photosensitive drum 3, along a rotational direction (the direction of an arrow X) thereof, a pre-exposing device 26 serving as a residual charge removing means for radiating light on the photosensitive drum 3 to remove residual charges, the corotron charging device 1 serving as a charging means (to be described later) for uniformly charging the surface of the photosensitive drum 3, and a developing device 30 serving as a developing means slit-exposed by an exposing device 28 serving as a latent image forming means (to be described later) arranged at the upper portion in the apparatus main body 12 to develop a latent image formed on the surface of the photosensitive drum 3 using a powdery developing agent T (to be referred to as a toner hereinafter), thereby forming a toner image IT serving as a powdery image are sequentially arranged.

In addition, a transfer charger 32 serving as a transferring means for transferring the toner image IT serving as a powdery image formed on the photosensitive drum 3 onto paper P supplied from the paper cassette 18 or 20, a separating charger 34 serving as a separating means for separating the paper P, to which the toner image IT is transferred, from the photosensitive drum 3, and a cleaner device 36 serving as a cleaning means for scraping off a toner T left on the photosensitive drum 3 are sequentially arranged.

The exposing device 28 is designed as follows. That is, the original D set on the platen glass 14 arranged on the upper surface of the apparatus main body 12 is illuminated by an exposing lamp 40 serving as a light source having a rear portion surrounded by a reflector 38, the light reflected from the original surface is guided to a lens 48 sequentially through a first mirror 42, a second mirror 44, and a third mirror 46, and the light transmitted through the lens 48 is guided to the photosensitive drum 3 through a fourth mirror 50.

The exposing lamp 40 and the first mirror 42 are arranged on a first carriage 52 which can be reciprocated along the lower surface of the platen glass 14, and the second and third mirrors 44 and 46 are arranged on a second carriage 54 which is moved along the lower surface of the platen glass 14 at a speed half the first carriage 52. While the exposing lamp 40 is lit, the first and second carriages 52 and 54 are moved to scan the image information of the original D set on the platen glass 14, slit exposure is performed between the charging device 1 and the developing device 30.

A paper convey path 58 for guiding the paper P, which is automatically supplied from the paper cassette 18 or 20, to the copy tray 22 through an image transfer unit 56 between the transfer charger 32 and the photosensitive drum 3 is formed in the apparatus main body 12.

A pair of resist rollers 60 arranged on the upstream side of the image transfer unit 56 in the convey direction of the paper P and used as a position adjusting means and a convey means are arranged on the paper convey path 58.

A convey device 62 having an endless belt, a heating roller type fixing device 64 serving as a fixing means, and a pair of paper exhaust rollers 68 are arranged on the downstream side of the image transfer unit 56 in the convey direction of the paper P.

Figure 2:
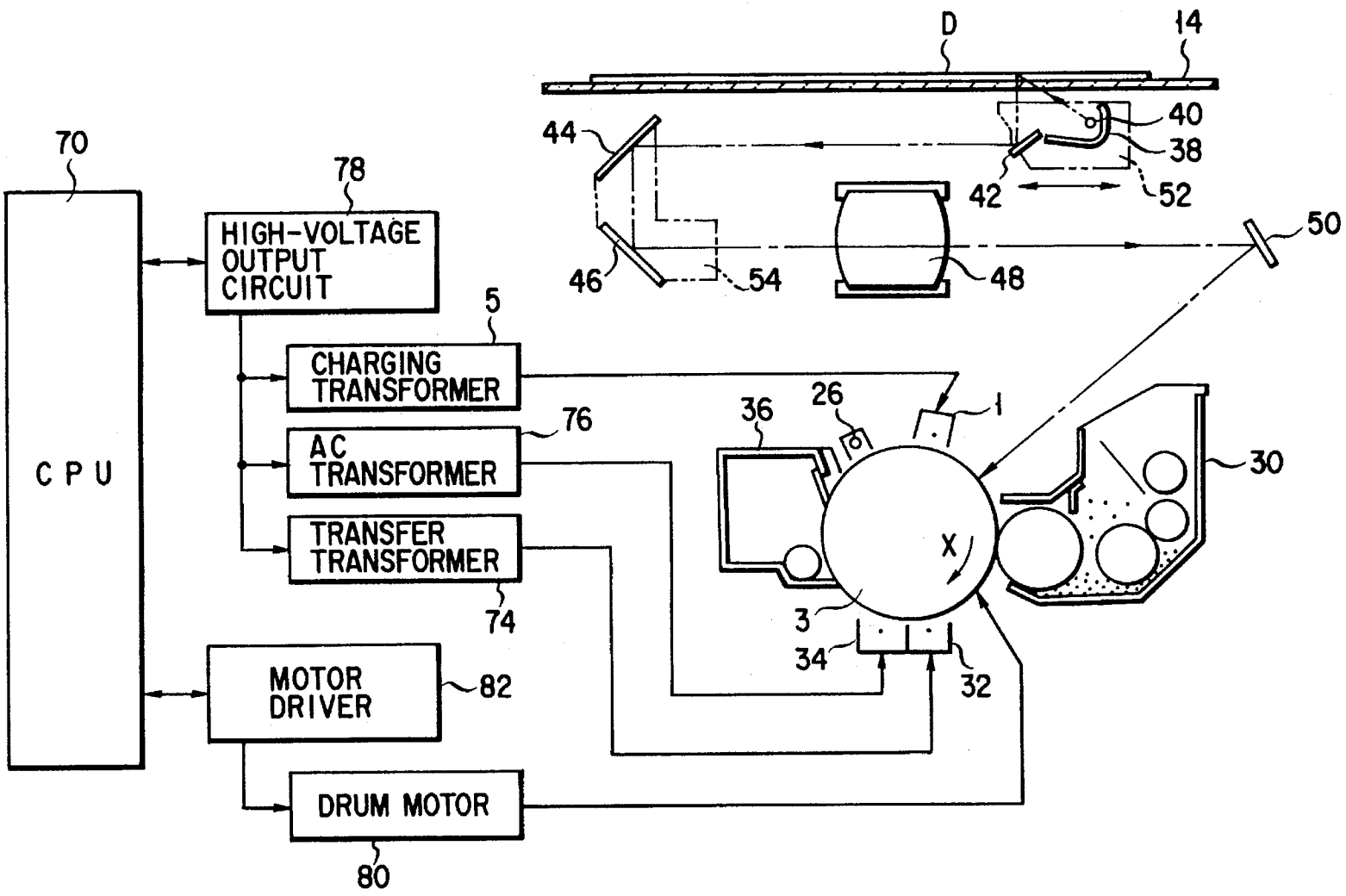
FIG. 2 is a block diagram showing the control section of the electrophotographic copying apparatus shown in FIG. 1.

The operation of the electrophotographic copying apparatus 10 arranged as described above is controlled by a CPU 70 serving as a control device shown in FIG. 2.

The CPU 70 has a ROM (not shown) which stores rules for operating the entire electrophotographic copying apparatus 10, e.g., control amounts for controlling the charging device 1, the pre-exposing device 26, and the exposing device 28, and the developing device 30, the transfer charger 32, the separating charger 34, and the cleaner device 36, a passing time taken for causing the paper P to pass through the paper convey path 58, and size data for checking the size of the paper P in each cassette on the basis of the size display portion of each of the cassettes 18 and 20.

In addition, the CPU 70 has a RAM (not shown) which temporarily stores copy count data and copy magnification data input from the control panel (not shown), the operation state of the electrophotographic copying apparatus 10 output from each sensor (not shown), e.g., a cassette selected at present, the present position of the paper P, or the like.

A high-voltage output circuit 78 for biasing a high-voltage transformer 5, a transfer transformer 74, and an AC transformer 76 for applying a high voltage to the charging device 1, the transfer charger 32, the separating charger 34, and the like, a motor driver 82 for biasing a drum motor 80 for driving the photosensitive drum 3, and the like are connected to the CPU 70.

The operation of the electrophotographic copying apparatus 10 to which the charging device 1 according to the present invention is applied will be described below.

When the original D is to be copied, the photosensitive drum 3 is rotated in the direction of an arrow X, residual charges are removed by the pre-exposing device 26, and then the photosensitive drum 3 is uniformly charged by the charging device 1.

The original D is scanned by the exposing device 28 above the uniformly charged photosensitive drum 3 to slit-expose the photosensitive drum 3. A latent image corresponding to the original D is formed on the photosensitive drum 3.

The developing device 30 supplies the toner T onto the latent image formed on the photosensitive drum 3, and the latent image is developed, thereby forming the toner image IT on the photosensitive drum 3.

On the other hand, while the toner image IT is formed on the photosensitive drum 3, the paper P is fed from the upper paper cassette 18 or the lower paper cassette 20 and brought into contact with the pair of stopped resist rollers 60 to adjust the position of the leading end of the paper P.

When a predetermined period of time has elapsed, the pair of resist rollers 60 are rotated to start an operation of conveying the paper P toward the image transfer unit 56, and the toner IT on the photosensitive drum 3 is transferred to the paper P by the operation of the transfer charger 32.

The paper P to which the toner image IT is transferred is separated by the separating charger 34 using AC corona discharging and then guided to the fixing device 64 through the convey device 62, and the toner image IT is melted and fixed on the paper P by the fixing device 64. Thereafter, the paper P is exhausted onto the copy tray 22 by the pair of paper exhaust rollers.

On the other hand, after the toner image IT is transferred to the paper P, the residual toner T on the photosensitive drum 3 is removed by the cleaning device 36, thereby making the next copying operation possible.

Figure 3:
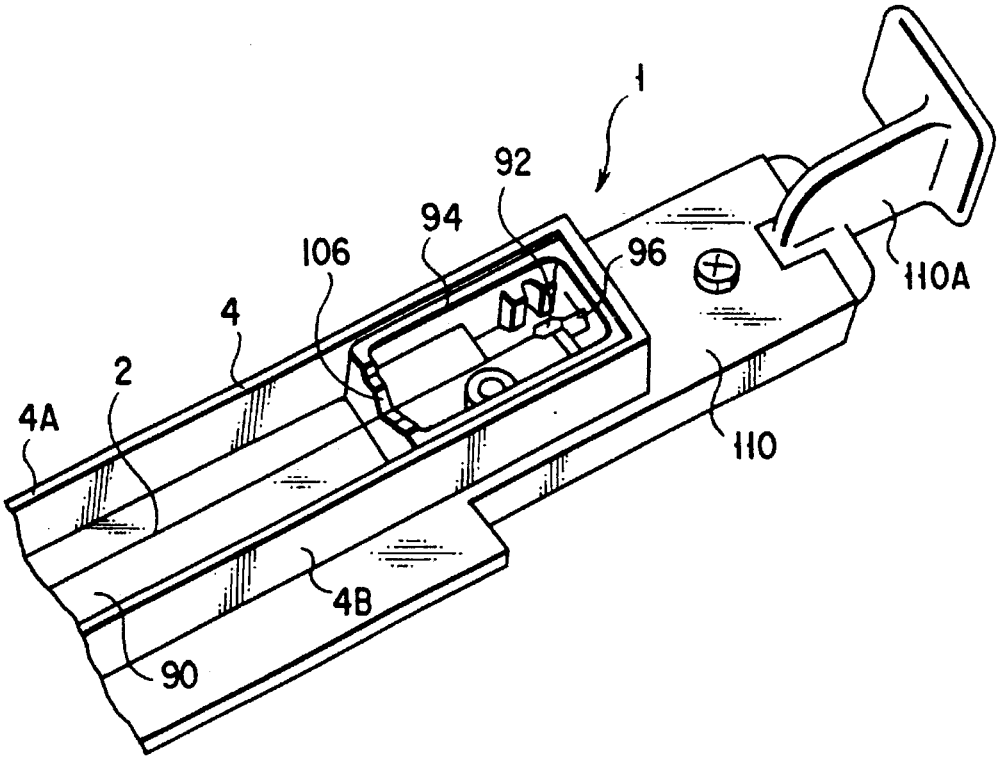
FIG. 3 is a perspective view showing the front side portion of a charging device according to an embodiment of the present invention.
Figure 4:
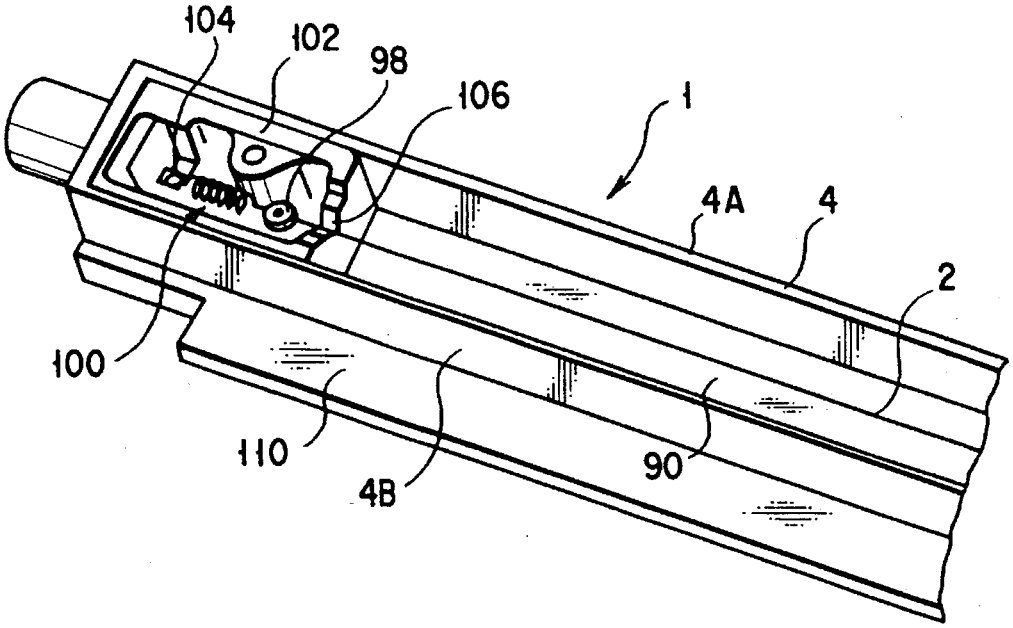
FIG. 4 is a perspective view showing a rear side portion of the charging device according to the embodiment of the present invention.

FIGS. 3 and 4 show the charging device 1 of the present invention. FIGS. 3 and 4 show the front and rear portions of the charging device 1, respectively.

Figure 5:
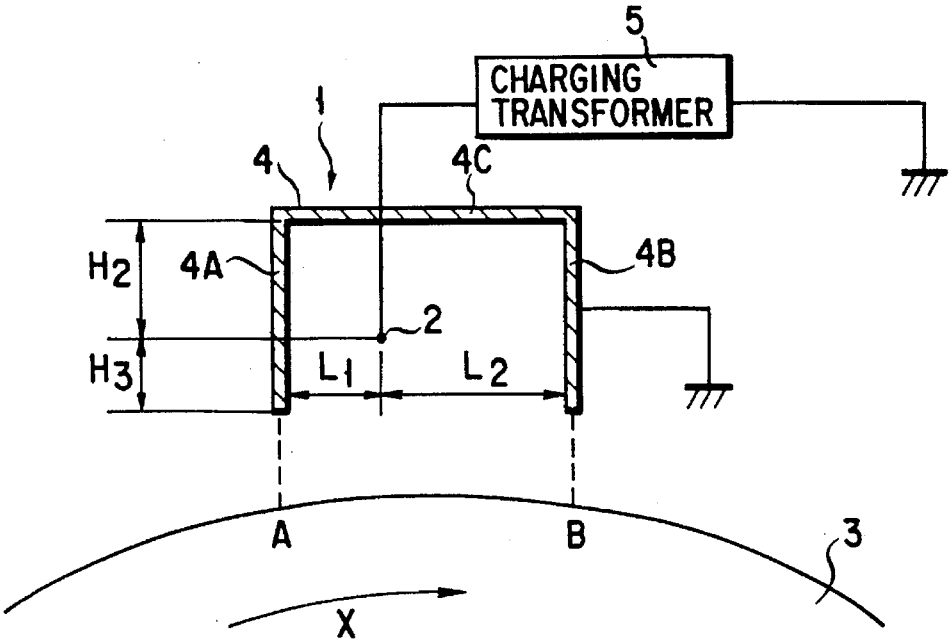
FIG. 5 is a schematic view showing the arrangement of the charging device according to the embodiment of the present invention.

The charging device 1, as shown in FIG. 5, is constituted by a corotron charging device having a charging wire (also called a corona discharging wire) 2 and a shield case 4 having a U-shaped sectional structure which surrounds the charging wire 2 and has an opening portion 90 opposing the photosensitive drum 3 serving as an object to be charged.

The charging wire 2 has one end connected, through a charging wire terminal 92, to a power supply terminal 96 of a terminal unit 94 arranged at the front end portion of the shield case 4, and the other end connected, sequentially through a charging wire terminal 98 and a conductive spring 100, to a power supplying terminal 104 of a terminal unit 102 arranged at the rear end portion of the shield case 4.

The charging wire 2 is positioned in the shield case 4 by V grooves 106 respectively formed in the terminal units 94 and 102. More specifically, the distances (sizes $L_1$ and $L_2$ in FIG. 5) between the charging wire 2 and first and second wall portions 4A and 4B located in the widthwise direction of the shield case 4 and the distances (sizes $H_2$ and $H_3$ in FIG. 5) between the charging wire 2 and a ceiling wall 4C of the shield case 4 and the opening end face of the shield case 4 are regulated by the V grooves 106.

In addition, the charging device 1, as shown in FIGS. 3 and 4, has a holder 110 having a handle 110A at one end located on the front side, and this holder 110 is engaged with an insertion guide (not shown) arranged in the apparatus main body 12 of the electrophotographic copying apparatus 10 and detachably supported in the longitudinal direction.

A high voltage is applied to the charging wire 2 through the high-voltage transformer (high-voltage transformer) 5, and the shield case 4 is grounded.

The charging wire 2 is offset to the upstream side in the rotational direction (direction of the arrow X) of the photosensitive drum 3, i.e., a direction toward an inlet portion A point of the shield case 4 ($L_1<L_2$) with respect to the central position of the shield case 4. That is, the charging wire 2 is arranged at the position of point (b) in FIG. 6.

In this embodiment, the length of the shield case 4 in the widthwise direction is 3 cm, and the charging wire 2 is arranged at a point spaced apart, by 10 cm, from the first wall surface 4A located on the upstream side in the rotational direction of the photosensitive drum with respect to the shield case 4. This position is set to be the position of point (b) in FIG. 6. In this manner, when the charging wire 2 is arranged at the position of point (b), the peak of a flow-in current flowing onto the photosensitive drum 3 is located at the position of point (b) in FIG. 7.

In this case, in this embodiment, the meaning of arranging the charging wire 2 at the position of point (b) in the shield case 4 will be described below.

When the charging wire 2 is arranged in the shield case 4 to perform a charging operation, the distribution of a flow-in current flowing onto the photosensitive drum 3 is given such that a flow-in current corresponding to the position of the charging wire 2 is largest, and the flow-in current decreases with an increase in distance between the photosensitive drum 3 and the charging wire 2.

In this case, most of charges for charging the surface of the photosensitive drum 3 are given by a charging operation performed at a position where the flow-in current has almost the peak value. However, the charging operation performed at the position where a flow-in current has an almost peak value has a large potential ripple to easily cause a charging irregularity.

The present applicant found out the following phenomenon. That is, in a charging operation performed by the charging device 1, a charging operation performed at a position where a flow-in current had a value smaller than the peak value had a small potential ripple. At the same time, the charging operation removed a charging irregularity caused by the charging operation performed at the position where the flow-in current had the almost peak value, and flattened the distribution of charges on the photosensitive drum 3.

More specifically, the present applicant found that, after a charging operation was performed at a position where the flow-in current had the peak value, when a charging operation was performed with a flow-in current having a value equal or smaller than the peak value for a period of time longer than that of the charging operation with the flow-in current having the peak value, a charging irregularity could be prevented.

However, when the charging wire 2 was arranged in the shield case 4 to be excessively close to the side wall of the upstream side in the rotational direction of the photosensitive drum 3, a current leaked from the charging wire 2 to the side wall of the shield case 4, and the charging operation could not be satisfactorily performed.

Figure 8:
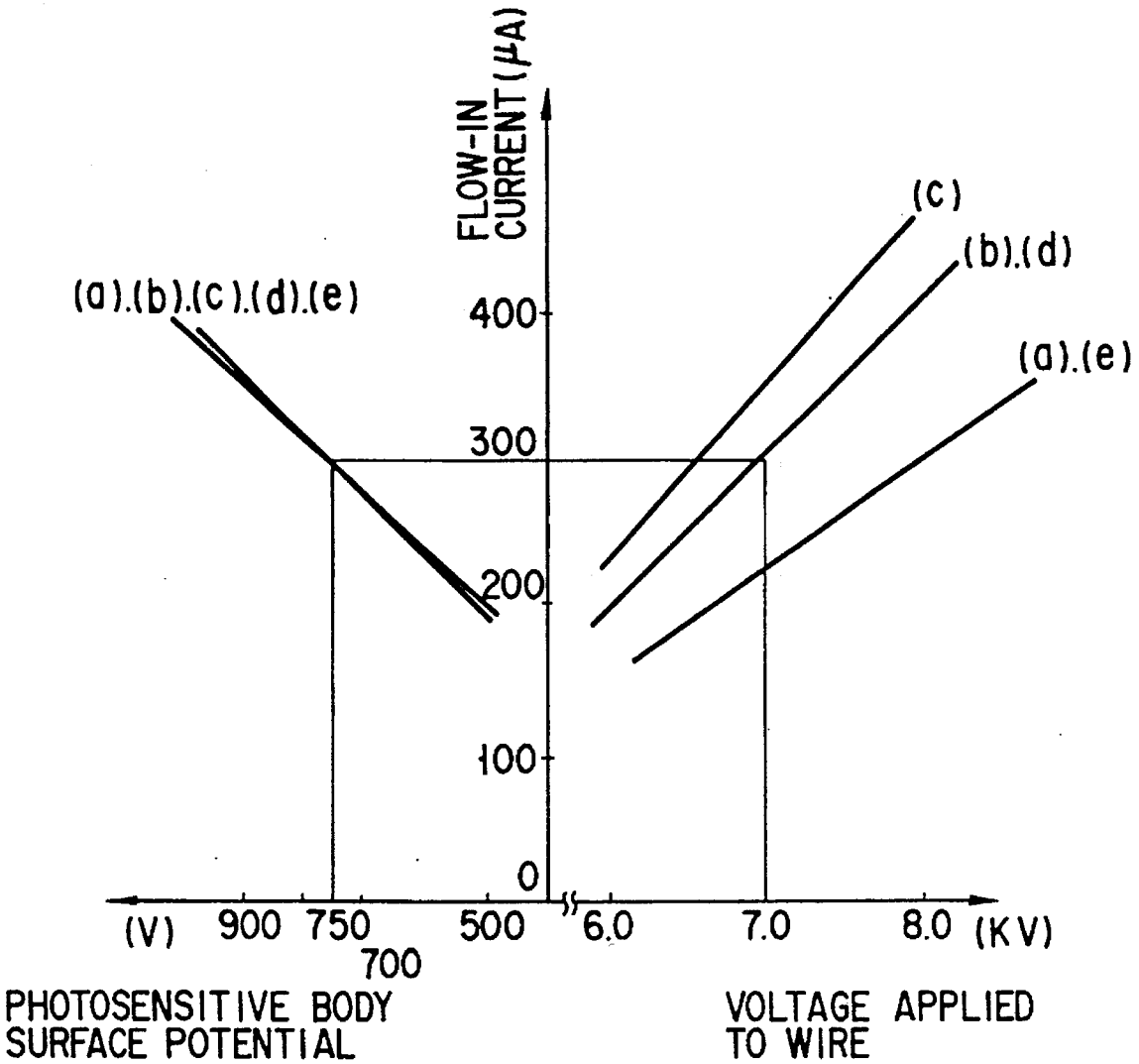
FIG. 8 is a graph showing the relationship between a flow-in current, a photosensitive body surface potential, and a voltage applied to a wire at each position when the plurality of arrangement positions for the charging wire are set as shown in FIG. 6.

For this reason, in this embodiment, in the shield case 4 in which the distance between both the side walls is 30 mm, the charging wire 2 is located at a position spaced apart, by 10 mm (20 mm from the second wall portion 4B), from the first wall portion 4A of the shield case 4 on the upstream side in the rotational direction of the photosensitive drum 3, i.e., the charging wire 2 is arranged at the position of point (b) in FIG. 8. In this case, a period of time for performing a charging operation with a flow-in current at a low current value equal to or smaller than the peak value is obtained, and current leakage from the charging wire 2 to the first wall portion 4A is prevented, thereby realizing a charging operation free from any charging irregularity.

Experiments wherein a charging operation is performed in the charging device 1 of this embodiment such that the position of the charging wire 2 in the shield case 4 is changed will be described below.

Figure 6:
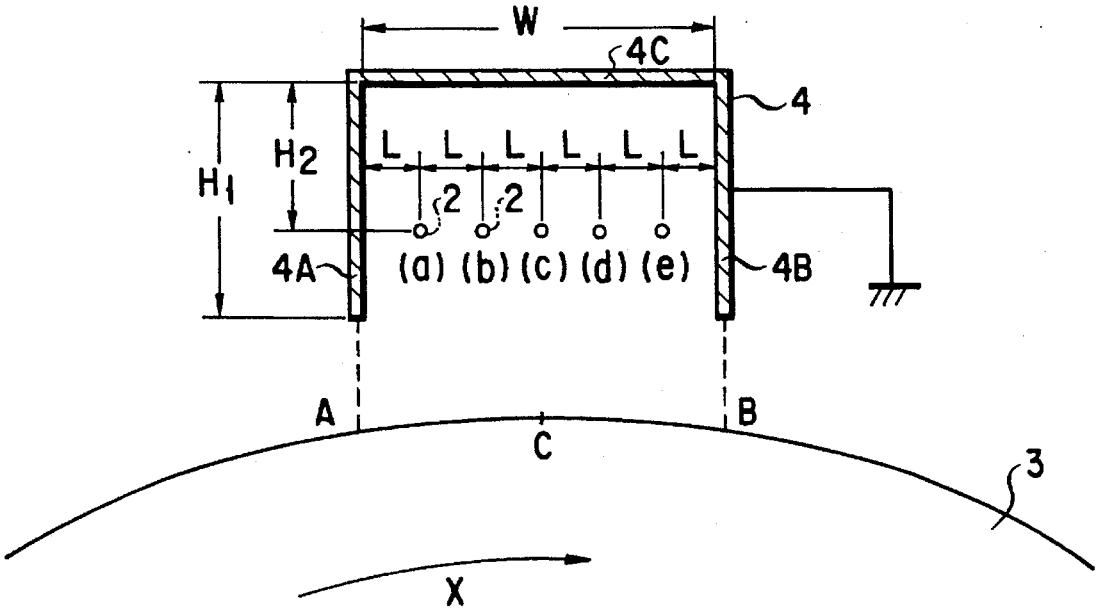
FIG. 6 is view showing a state wherein a plurality of arrangement positions for a charging wire are set in this embodiment.
Figure 7A:
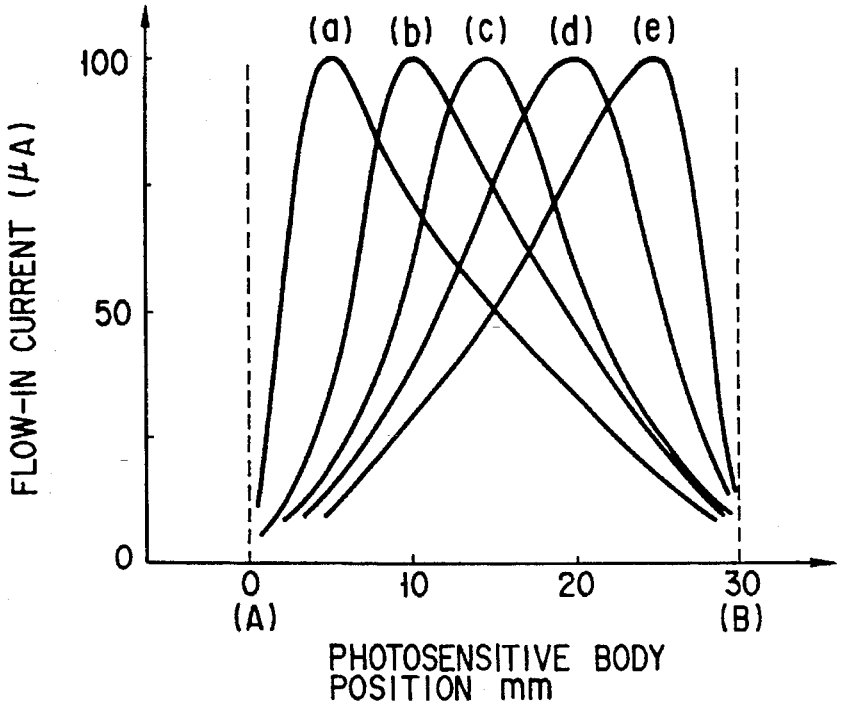
FIG. 7A is a graph showing the state of a flow-in current flowing onto the photosensitive body at each position when the plurality of arrangement positions for the charging wire are set as in FIG. 6.

In FIG. 6, an interval W between the first and second wall portions 4A and 4B located in the widthwise direction of the shield case 4 was set to be 30 mm, a length $H_1$ of each of the first and second wall portions 4A and 4B from the ceiling wall 4C was set to be 20 mm, and a length $H_2$ of the charging wire 2 from the ceiling wall 4C was set to be 13 mm, and an interval L between positions at which the charging wire 2 is arranged was set to be 5 mm. More specifically, point (a) denotes a state wherein the charging wire 2 is arranged at a position spaced apart from the inlet portion A point of the shield case 4 by 5 mm, that is, the wire 2 is located upstream of the middle portion of the case 4 and closer to the inlet portion A point than to the middle portion of the case 4; (b), a state wherein the charging wire 2 is arranged at a position spaced apart from the point A of the inlet portion of the shield case 4 by 10 mm, that is, the wire 2 is located upstream of the middle portion of the case 4 and closer to the center position C of the case 4 than to the inlet portion A point; (c), a state wherein the charging wire 2 is arranged at a position spaced apart from the inlet portion A point of the shield case 4 by 15 mm, i.e., at the central position of the shield case 4; (d), a state wherein the charging wire 2 is arranged at a position spaced apart from the inlet portion A point of the shield case 4 by 20 mm and spaced apart from the outlet portion B point of the shield case 4 by 10 mm, that is, the wire 2 is located downstream of the middle portion of the case 4 and closer to the middle portion of the case 4 than to the outlet portion B point; and (e), a state wherein the charging wire 2 is arranged at a position spaced apart from the inlet portion A point of the shield case 4 by 25 mm and spaced apart from the outlet portion B point of the shield case 4 by 5 mm, that is, the wire 2 is located downstream of the middle portion of the case 4 and located closer to the outlet portion B point than to the middle portion of the case 4.

when the charging wire 2 is set at the positions of points (a), (b), (c), (d), and (d), respectively, the peaks of a flow-in current (corona current) flowing from the opening portion 90 of the shield case 4 onto the photosensitive drum 3 are set at the positions of points (a), (b), (c), (d), and (e) in FIG. 7. The current leaking from the wire 2 into the walls 4A, and 4B of the case 4 (to be described later) is not taken into account as to the current value shown in FIG. 7A.

As shown in FIG. 7A, the peak of charging is moved to the inlet side of the charging device 1 with a decrease in distance between the charging wire 2 and the first wall portion 4A of the shield case 4, and an area charged with a flow-in current having a value equal to or smaller than the peak current value is offset to the outlet side of the charging device 1. In addition, the peak of charging is moved to the outlet side of the charging device 1 with a decrease in distance between the charging wire 2 and the second wall portion 4B of the shield case 4, and an area charged by a small flow-in current having a value equal to or smaller than the peak value is offset to the inlet side of the charging device 1.

FIG. 8 shows the relationship between a flow-in current, a photosensitive body surface potential, and a voltage applied to a wire at each of points (a), (b), (c), (d), and (e) in FIG. 7A.

As is apparent from FIG. 8, if the charging wire 2 is located at any position indicated by point (a), (b), (c), (d), or (e), the photosensitive body surface potential obtained at the flow-in current of about 350 μA is 750 V, and the photosensitive body surface potential obtained at the flow-in current of about 200 μA is about 500 V. Therefore, the flow-in current is properly proportional to the photosensitive body surface potential, and the flow-in current and the photosensitive body surface potential do not depend on the position of the charging wire 2.

Figure 7B:
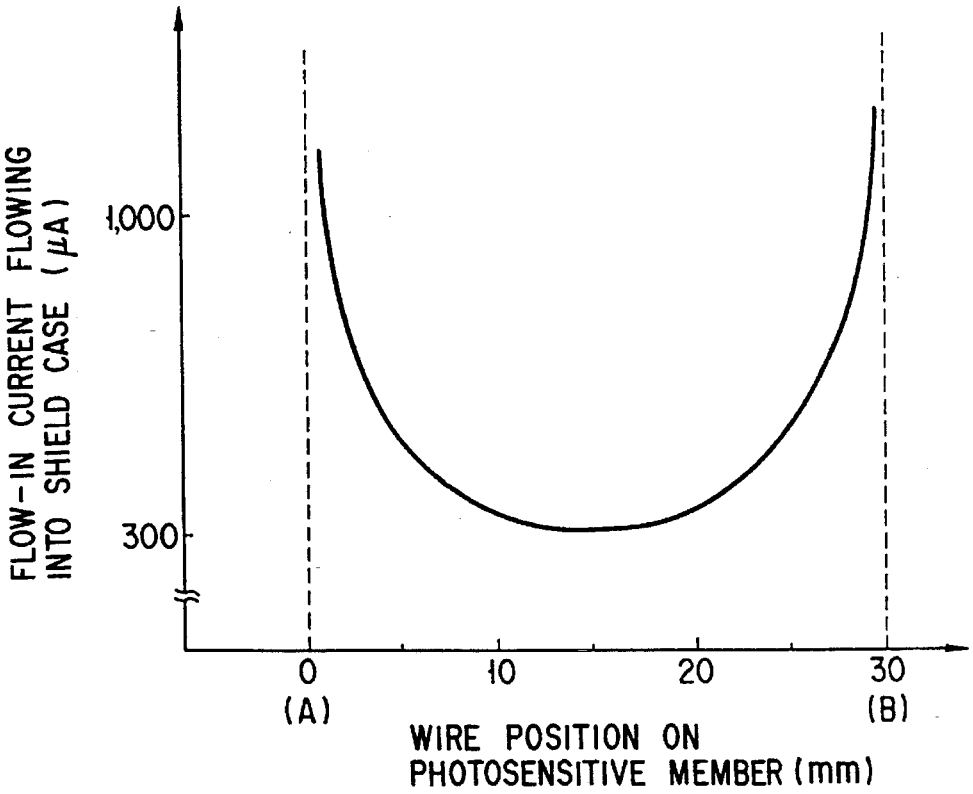
FIG. 7B is a graph showing the state of a flow-in current flowing into the shield case at each position when the plurality of arrangement positions for the charging wire are set as shown in FIG. 6.

However, when the differences between voltages applied to the wire and surface currents are compared with each other, it is found that a flow-in current is effectively generated when the distance between the position of the charging wire 2 and the central position of the shield case 4 is decreased. This is because, when the charging wire 2 is arranged at the position of point (a) or (e) in FIG. 6, charges leak from the charging wire 2 to the shield case 4. FIG. 7B shows the value of the current which flows into the case 4 when a total amount of current is 1000 μA.

A flow-in current flowing from the wire 2 into the shield case 4, as indicated in FIG. 7B, increases when the wire 2 comes closer to the shield case 4.

At the central position C of the shield case 4 which is farthest from both the walls of the shield case 4, the flow-in current flowing into the shield case 4 is minimum, as a matter of course.

In this case, as shown in FIG. 7B, it is found that the flow-in current flowing from the wire 2 into the shield case 4 steeply increases when the arrangement position of the wire 2 passes the middle point between the central position of the shield case 4 and each of the wall surfaces 4A and 4B of the shield case 4.

A leakage current flowing from the wire 2 into the shield case 4, as shown in FIG. 7B, exponentially increases when the position of the wire 2 becomes close to the wall of the shield case 4. Therefore, since a large part of current leaks into the shield case 4 at points (a) and (e), even when a voltage of 7.0 kv is applied, a current flowing from the wire 2 onto the surface of the photosensitive member is about 220 μA at most. For this reason, a flow-in current amount which is enough to sufficiently charge the surface of the photosensitive member cannot be obtained.

Therefore, in order to increase the charging efficiency by suppressing the amount of a flow-in current flowing from the wire 2 into the shield case 4, the wire 2 is preferably arranged at a position slightly offset on the center side of the shield case 4 with respect to the middle point between the central position of the shield case 4 and the wall surface of the shield case 4. That is, the wire 2 is preferably arranged at a position such that the distance between the wire 2 and the wall surface of the shield case 4 is longer than the distance between the wire 2 and the central position of the shield case 4. Therefore, in the example shown in FIG. 6, the wire 2 is arranged at the position indicated by point (b), (c), or (d).

Therefore, judging from the relationship between the flow-in current and the voltage applied to the wire, the charging wire 2 is preferably arranged at the position of point (b), (c), or (d) in FIG. 6.

However, when the charging wire 2 is arranged at point (c) located at the central position of the shield case 4, and the charging wire 2 is arranged at point (d) located near the outlet portion B point of the shield case 4, a charging irregularity occurs on the photosensitive drum 3, and a good halftone image cannot be obtained. As in the present invention, when the charging wire 2 is offset to the upstream side in the rotational direction of the photosensitive drum 3 with respect to the central position of the shield case 4, i.e., when the charging wire 2 is arranged at point (b) near the inlet portion A point of the shield case 4, a good halftone image can be obtained without causing a charging irregularity on the photosensitive drum 3.

A reason why the above phenomenon occurs will be described below with reference to FIGS. 9A, 9B, and 9C.

Figure 9A:
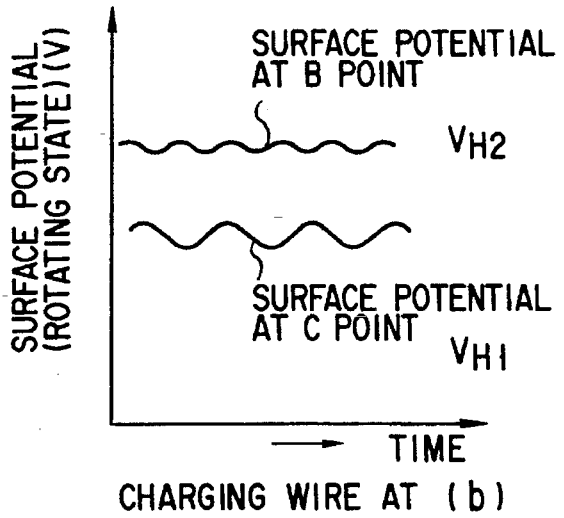
FIG. 9A is a graph for explaining the states of surface potentials at the inlet and outlet portions of a shield case when the charging wire is arranged at the position of point (b) in FIG. 6.
Figure 9B:
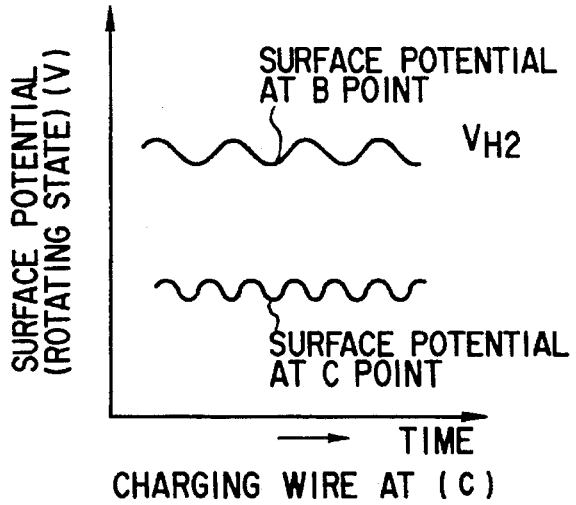
FIG. 9B is a graph for explaining the states of surface potentials at the inlet and outlet portions of the shield case when the charging wire is arranged at the position of point (c) in FIG. 6.

FIG. 9A shows a case wherein the charging wire 2 is arranged at point (b) offset to the inlet portion A point with respect to the central position of the shield case 4. FIG. 9B shows a case wherein the charging wire 2 is arranged at point (c) offset to the outlet portion B point with respect to the central position of the shield case 4. FIG. 9C shows a case wherein the charging wire 2 is arranged at point (c) located at the central position of the shield case 4.

When the charging wire 2 is arranged at point (b) nearer the inlet portion A point than the central position of the shield case 4 of the present invention, the peak of discharging, as described above, is offset to the inlet portion A point as shown in FIG. 7A.

For this reason, at a position C point on the photosensitive drum 3 opposing the central position of the shield case 4 of the charging device 1, most of charges contributing to the charging operation are supplied.

At this time, the charging irregularity is left at the C point on the photosensitive drum 3, and as shown in FIG. 9A, a surface potential $V_{H1}$ at the C point on the photosensitive drum 3 varies. However, since the charging wire 2 is arranged at the position of the point (b), the peak of charging has passed the C point, and a charging operation performed with a flow-in current having a small value continues to the outlet portion B point of the charging device 1.

Therefore, the charging irregularity present at the C point has been corrected at the outlet portion B point, and a stable surface potential $V_{H2}$ can be obtained. The surface of the photosensitive drum 3 is uniformly charged, and the next process is to be performed. In this manner, when the charging wire 2 is arranged at the position of point (b), even if a half-tone image is output, image non-uniformity does not occur.

when the charging wire 2 is arranged at point (c) corresponding to the central position of the shield case 4, the peak of charging is located immediately under the central position of the shield case 4. For this reason, a charging irregularity as shown in FIG. 9B occurs at the C point on the photosensitive drum 3 corresponding to the position immediately under the charging wire 2 arranged at point (c).

When the charging wire 2 is arranged at the C point, a charging operation on the photosensitive drum 3 with a small flow-in current is performed from the position immediately under the position of point (c) of the charging wire 2 to the outlet portion B point. However, in this case, since an area charged with the small flow-in current is smaller than that obtained when the charging wire 2 is arranged at point (b), the effect of uniforming a charging irregularity cannot be satisfactorily obtained. As shown in FIG. 9B, the charging irregularity is slightly left on the photosensitive drum 3 with respect to the surface potential $V_{H2}$.

In addition, when the charging wire 2 is arranged at point (d) nearer to the outlet portion B point than the central position of the shield case 4, the peak of discharging is offset to the outlet portion B point with respect to the central position of the shield case 4. For this reason, since a charging operation performed with the flow-in current having the peak value has not been performed at the position C point on the photosensitive drum 3 opposing the central position of the shield case 4, although a charging irregularity is small as shown in FIG. 9B, the position C point on the photosensitive drum 3 is rarely charged.

Thereafter, when the photosensitive drum 3 is continuously rotated, and the C point reaches the position immediately under the charging wire 2 arranged at point (d) of the shield case 4, the photosensitive drum 3 is charged with a flow-in current having the peak value, and most of charges are supplied onto the photosensitive drum 3. However, in this case, on the photosensitive drum 3 which is charged with the flow-in current having a value equal to or smaller than the peak value, an area charged with a small current having a value equal to or smaller than the peak value is a small area between a portion immediately under the charging wire 2 arranged at point (d) and the outlet portion B point.

Figure 9C:
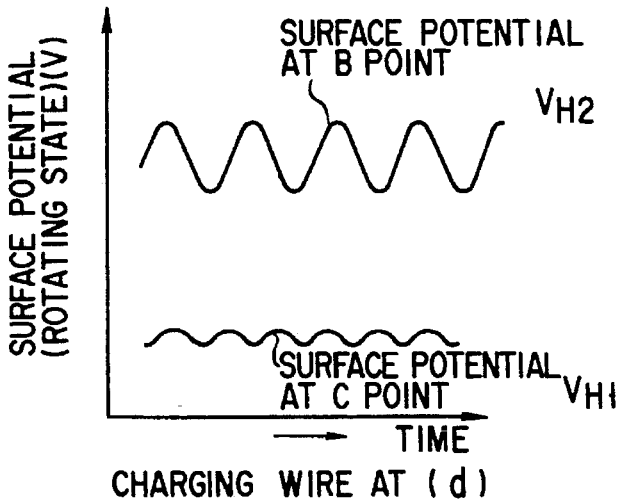
FIG. 9C is a graph for explaining the states of surface potentials at the inlet and outlet portions of the shield case when the charging wire is arranged at the position of point (d) in FIG. 6.

For this reason, since an effect of uniforming a charging irregularity cannot be satisfactorily obtained, as shown in FIG. 9C, almost all the charging irregularity occurring when the charging operation is performed with the flow-in current having the peak value is left at the outlet portion B point on the photosensitive drum 3 with respect to the surface potential $V_{H2}$.

More specifically, when the charging wire 2 is arranged at point (c) or (d), while the charging irregularity is left on the surface of the photosensitive drum 3, the photosensitive drum 3 is continuously rotated to perform the next step. In particular, as in this embodiment, when a halftone image is output using a planished drum, non-uniformity occurs on the image.

Figure 10B:
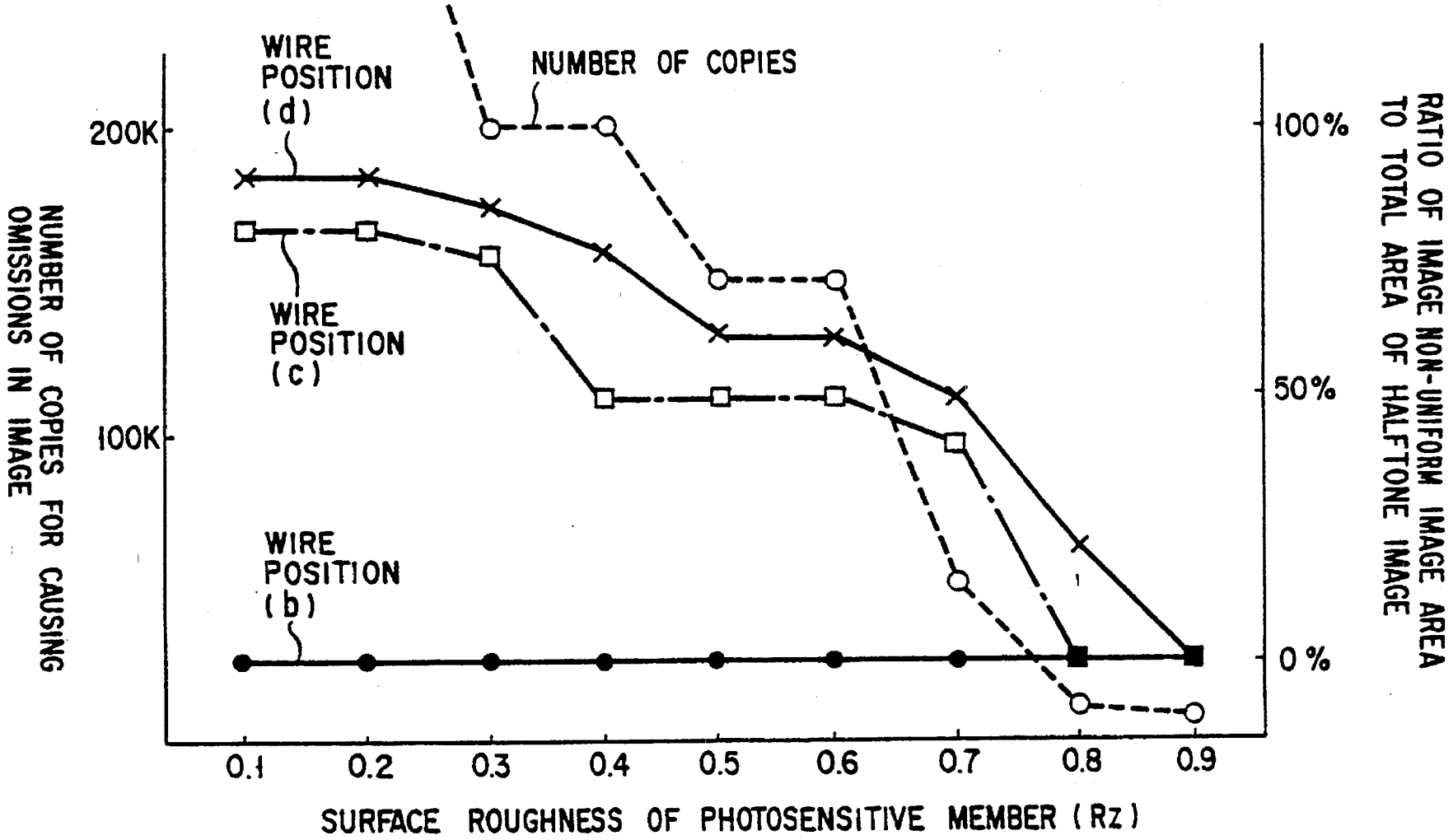
FIG. 10B is a graph showing the disadvantageous state in the experiment performed using the surface roughness ($R_Z$) of the photosensitive member as a parameter.

In the above embodiment, a case wherein the surface roughness of the photosensitive drum 3 is $R_Z$=0.1 has been described. An embodiment in which the surface roughness $R_Z$ of the photosensitive drum 3 is changed from 0.1 to 0.9 will be described below. In this case, image formation conditions are: V0=+750 V; Vb=+200 V; and the concentration of a halftone image as Id=0.6. When a copying operation is continuously performed under these conditions, the number of copies until omissions occur on an image due to a charging fault was measured, and a ratio of an non-uniform image area to the entire area of one copy image was measured. The results are shown in FIGS. 10A and 10B.

Consider a period taken for forming an image with omissions when a surface roughness is used as a parameter. As described above, when the surface roughness of a photosensitive drum increases, paper dust, toner and the like are known to clog the depressed portions on the photosensitive drum, and a current leaks to the clogging paper dust and the like, thereby causing a charging fault. According to this experimental result, when the surface roughness $R_Z$ of the photosensitive member was 0.2 or less, an image was formed without omissions. However, when the surface roughness $R_Z$ exceeded 0.3, an image with omissions was formed. It is found that the number of copies for causing omissions in an image decreases when the surface roughness increases ($R_Z$ increases).

A ratio of an non-uniformity image area to the total area of a halftone image, using a surface roughness as a parameter, will be considered with respect to the position of the wire. An experimental result obtained when the wire 2 is located at (b) point will be considered first. When the wire 2 was located at the position of point (b) which was offset on the upstream-side in the rotational direction of the photosensitive member 3 with respect to the central position of the shield case 4, any image non-uniformity in a halftone image occurred regardless of the surface roughness of the photosensitive drum 3 due to the following reason. This is, since charging non-uniformity can be almost eliminated when the wire 2 is offset to the upstream-side as described above, a toner is uniformly distributed on the photosensitive member 3 even when a halftone image is developed. When the wire 2 is located at point (c), the ratio of a non-uniformity image area to the total area of the halftone image increases when the surface roughness $R_Z$ decreases. This tendency becomes more conspicuous when the wire 2 is located at point (d) positioned on the downstream-side of point (c) in the shield case 4. The reason why the tendency becomes more conspicuous has been described above. That is, when the surface roughness of the drum decreases, the toner image is easily affected by the charging non-uniformity.

Judging from the above experimental results, to prevent image omissions and halftone image non-uniformity, the following conditions are essential conditions. That is, a planished drum having a surface roughness $R_Z$ of 0.2 or less is used as the photosensitive drum 3, and the charging wire 2 is arranged at a position offset on the upstream-side in the rotational direction of the photosensitive member with respect to the central position of the shield case 4. In addition, as described above, when the wire 2 comes excessively close to a wall surface of the shield case 4, a flow-in current flowing onto the photosensitive member 3 is minimized. For this reason, the charging wire 2 must be tensed at a position which is offset on the upstream-side in the rotational direction of the photosensitive member with respect to the central position of the shield case 4 and is nearer to the central position of the shield case 4 than the wall surface of the shield case 4. With the above arrangement, in any case, a fine image free from non-uniformity can be formed.

In the above embodiment, the charging device having one charging wire 2 has been described. However, in a charging device having a plurality of charging wires 2, e.g., two charging wires 2, as shown in FIG. 11, when two wires 2 are arranged such that the peak of a charging flow-in current, described in the above embodiment, is shifted to the upstream side in the rotational direction of a photosensitive body, i.e., to an inlet portion A side, with respect to the central position of a shield case 4, a good halftone image can be obtained.

Figure 11:
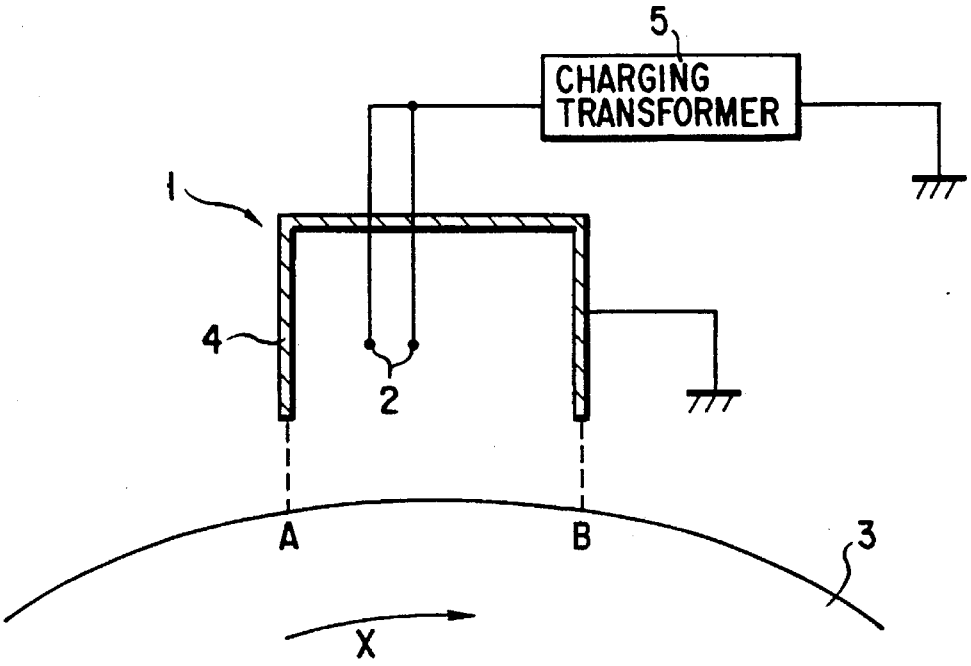
FIG. 11 is a schematic view showing the arrangement of a charging device according to the second embodiment of the present invention.

The same reference numerals as in the arrangement of the above embodiment denote the same parts in the description of FIG. 11, and a description thereof will be omitted.

Figure 12:
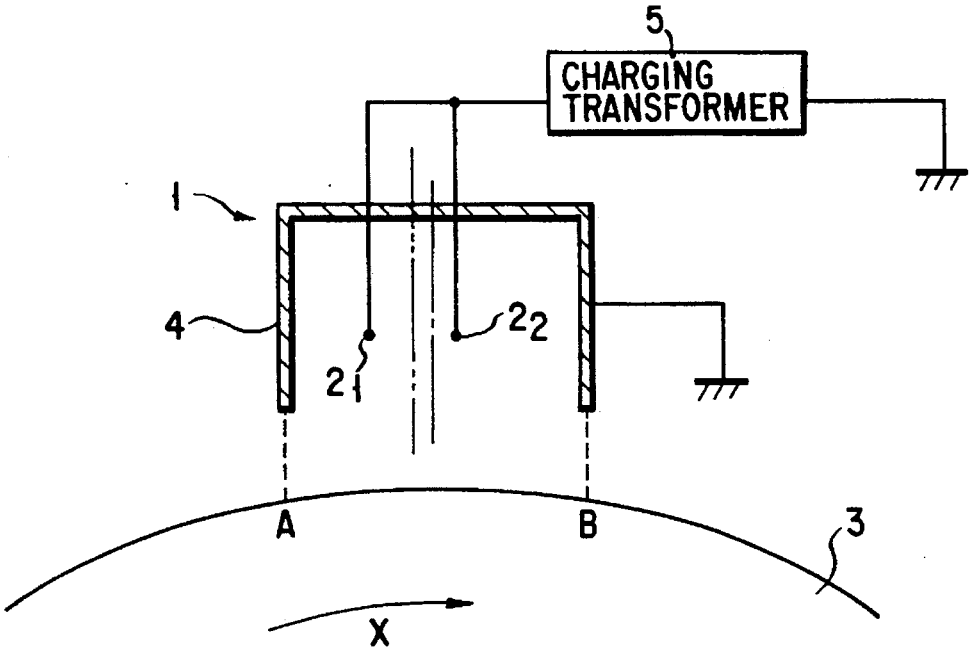
FIG. 12 is a schematic view showing the arrangement of a charging device according to the third embodiment of the present invention.

As shown in FIG. 12, when a plurality of charging wires $2_1$ and $2_2$ are arranged in a shield case 4, a middle position (a chain double-dashed line in FIG. 12) of a distance between the charging wire $2_1$ arranged in the shield case 4 on the most upstream side in the rotational direction of a photosensitive body and the charging wire $2_2$ arranged on the most upstream side may be shifted to the upstream side in the rotational direction of the photosensitive body 3 with respect to the central position of the shield case 4. In this arrangement, since the peak of a current flowing from the charging wires $2_1$ and $2_2$ onto the photosensitive body 3 is shifted to the upstream side in the rotational direction of the photosensitive body 3 with respect to the central position of the shield case 4, a good half-tone image can be obtained.

The same reference numerals as in the arrangement of the above embodiment denote the same parts in the description of FIG. 12, and a description thereof will be omitted.

Various changes and modifications of the present invention can be effected without departing from the spirit and scope of the present invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A charging device, comprising:

a case arranged to have an opening opposing a surface of a photosensitive member rotated in a predetermined direction and having a surface roughness $R_Z$ of not more than 0.2;

a wire tensed in said case at an offset position offset on an upstream-side in a rotational direction of said photosensitive member and being spaced apart from the surface of the photosensitive member by a first distance wherein said first distance is the same as a distance from the wire to the surface when the wire is placed at a central position of a width of said case; and means for applying a voltage to said wire.

2. An image forming apparatus, comprising:

a photosensitive member rotated in a predetermined direction and having a surface roughness $R_z$ of not more than 0.2;

charging means for causing a current having a predetermined peak value to flow onto a surface of said photosensitive member having the surface roughness $R_Z$ of not more than 0.2 to charge the surface of said photosensitive member, the peak of the flow-in current being offset on an upstream-side in a rotational direction of said photosensitive member, said charging means having a case and a wire, said wire for supplying a charge corresponding to a voltage supplied to said wire, said case having a wire supporting member for supporting the wire, the wire supporting member supporting the wire at an arbitrary position shifted from a central position of the case in a width direction, and a distance between the wire supporting member and the surface of the photosensitive member being substantially constant between the central position and the arbitrary position; and means for applying said voltage to said wire.

3. An image forming apparatus, comprising:

a photosensitive member, having a planished surface thereon, said photosensitive member being configured to rotate in a predetermined direction, and a surface roughness of the planished surface being within a range $R_Z$=0 to 2.0;

charging means for charging the planished surface of the photosensitive member by flowing a current to the planished surface of the photosensitive member, said charging means having a wire and a case having an opening opposing the planished surface of the photosensitive member, and said wire being tensed at a position located at an upstream-side in the predetermined direction of the photosensitive member with respect to a central position of the case in a width direction, and a distance between an upstream-side wall of the case and the wire being longer than a distance between the central position of the case and the wire, said case having a wire supporting member for supporting the wire the wire supporting member supporting the wire at an arbitrary position shifted along with the surface of the photosensitive member from the central position of the case in a width direction, and a distance between the wire supporting member and the surface of the photosensitive member being substantially constant between the central position and the arbitrary position; and voltage supplying means for supplying voltage to the wire of the charging means.

4. An image forming apparatus, comprising:

a photosensitive member, having a planished surface thereon, rotates in a predetermined direction, and a surface roughness of the planished surface is $R_Z$=0 to 2.0;

charging means for charging the planished surface of the photosensitive member by flowing a current to the planished surface of the photosensitive member, said charging means having two wires and a case having an opening opposing the planished surface of the photosensitive member, and said wires being tensed at a position where a middle position of a distance between those two wires is shifted to an upstream-side in the rotational direction of the photosensitive member with respect to a central position of the case; and voltage supplying means for supplying voltage to the wires of the charging means.

5. An image forming apparatus, comprising:

a photosensitive member rotatable in a predetermined direction and having a surface roughness $R_Z$ of not more than 0.2;

charging means constituted by a case arranged to have an opening opposing a surface of said photosensitive member having the surface roughness $R_Z$ of not more than 0.2 and at least one wire tensed in said case at a position offset on an upstream-side in a rotational direction of said photosensitive member with respect to a central position of a width of said case in a direction along a moving direction of said photosensitive member, said case having a wire supporting member for supporting at least one wire, the wire supporting member supporting at least one wire at an arbitrary position shifted from the central position of a width of the case, and a distance between the wire supporting member and the surface of the photosensitive member being substantially constant between the central position and the arbitrary position;

means for applying a voltage to said at least one wire of said charging means;

latent image forming means for radiating light on the surface of said photosensitive member uniformly charged by said charging means to form a latent image on said photosensitive member; and developing means for supplying a developing agent onto the latent image formed by said latent image forming means to develop the latent image.

6. An image forming apparatus, comprising:

a photosensitive member, having a planished surface thereon, rotatable in a predetermined direction, and with a surface roughness of the planished surface within a range of $R_Z$=0 to 2.0;

charging means for charging the planished surface of the photosensitive member by allowing a current to flow to the planished surface of the photosensitive member, said charging means having a wire and a case having an opening opposite to the planished surface of the photosensitive member, said wire being tensed at a position located on an upstream-side in a rotational direction of the photosensitive member with respect to a central position of the case, a distance between an upstream-side wall of the case and the wire being longer than a distance between the central position of the case and the wire, the amount of the current decreasing gradually toward a downstream-side in the rotational direction of the photosensitive member with respect to the central position of the case, said case having a wire supporting member for supporting the wire, the wire supporting member supporting the wire at an arbitrary position shifted from the central position of the case in a width direction, and a distance between the wire supporting portion and the surface of the photosensitive member being substantially constant between the central position and the arbitrary position; and voltage supplying means for supplying a voltage to the wire of the charging means.

7. A charging device, comprising:

a wire for supplying a charge corresponding to a voltage supplied thereto;

a case having an opening portion, said opening portion opposing to a surface of a photosensitive member, the surface having a surface roughness represented by $R_Z$ of no more than 0.2, said case having a wire supporting member for supporting the wire, the wire supporting member supporting the wire at an arbitrary position which is offset from a central position of the case in a width direction, and a distance between the wire supporting portion and the surface of the photosensitive member being substantially constant between the central position and the arbitrary position; and applying means for applying a voltage to the wire.

* * * * *